US008113552B2

(12) United States Patent
Ritt et al.

(10) Patent No.: US 8,113,552 B2
(45) Date of Patent: Feb. 14, 2012

(54) LOCKING DEVICE

(75) Inventors: Alois Ritt, Amstetten (AT); Johann Bramauer, Ybbsitz (AT)

(73) Assignee: Knorr-Bremse Ges. m.b.H., Modling (AT)

( * ) Notice: Subject to any disclaimer, the term of this patent is extended or adjusted under 35 U.S.C. 154(b) by 982 days.

(21) Appl. No.: 11/587,247

(22) PCT Filed: Apr. 19, 2005

(86) PCT No.: PCT/EP2005/004127

§ 371 (c)(1),
(2), (4) Date: Oct. 4, 2007

(87) PCT Pub. No.: WO2005/103429

PCT Pub. Date: Nov. 3, 2005

(65) Prior Publication Data

US 2008/0190151 A1 Aug. 14, 2008

(30) Foreign Application Priority Data

Apr. 23, 2004 (AT) ..... A 706/2004
Sep. 17, 2004 (AT) ..... A 1573/2004

(51) Int. Cl.
*E05C 3/06* (2006.01)

(52) U.S. Cl. ..... 292/201; 49/280; 292/51; 292/144

(58) Field of Classification Search ..... 49/280, 49/334–337, 340, 341; 292/51, 142, 144, 292/199, 201; 70/95
See application file for complete search history.

(56) References Cited

U.S. PATENT DOCUMENTS

| | | | | |
|---|---|---|---|---|
| 1,646,181 | A * | 10/1927 | Babekuhl | 70/100 |
| 4,198,786 | A | 4/1980 | Monot | |
| 5,077,938 | A | 1/1992 | Moreuil | |
| 5,263,280 | A | 11/1993 | Dilcher | |
| 5,341,598 | A | 8/1994 | Reddy | |
| 5,826,377 | A | 10/1998 | Simson et al. | |
| 6,282,970 | B1 | 9/2001 | Oakley | |
| 6,446,389 | B1 | 9/2002 | Heffner et al. | |
| 6,860,064 | B2 * | 3/2005 | Bakalar | 49/127 |
| 6,941,701 | B2 * | 9/2005 | Inage | 49/449 |
| 7,004,516 | B2 * | 2/2006 | Stojc | 292/201 |
| 7,007,427 | B2 * | 3/2006 | Sanke et al. | 49/199 |
| 7,228,804 | B2 * | 6/2007 | Stojc et al. | 105/286 |
| 7,665,794 | B2 * | 2/2010 | Kachouh | 296/146.3 |
| 2007/0024062 | A1 * | 2/2007 | Compeau | 292/199 |

FOREIGN PATENT DOCUMENTS

| | | | |
|---|---|---|---|
| DE | 28 19 424 | A1 | 8/1979 |
| DE | 199 46 501 | A1 | 4/2001 |
| EP | 0 820 889 | A1 | 8/1979 |
| EP | 452 201 | | 10/1991 |
| EP | 0 517 334 | A1 | 10/1992 |
| EP | 0 860 339 | A1 | 8/1998 |
| EP | 0 875 434 | A1 | 11/1998 |
| EP | 0 878 371 | A1 | 11/1998 |
| EP | 0 903 275 | A1 | 3/1999 |

* cited by examiner

*Primary Examiner* — Kristina Fulton
(74) *Attorney, Agent, or Firm* — Barnes & Thornburg LLP

(57) ABSTRACT

A locking device for a sliding door or a swing and sliding door having a door leaf, the lock device comprising a drive train including at least one motor, a drive transmission and a drive spindle. The locking device also comprises a locking transmission and a torque dividing arrangement.

9 Claims, 8 Drawing Sheets

LOCKING DEVICE

BACKGROUND AND SUMMARY

The present disclosure relates to sliding doors or swing and sliding doors of vehicles such as subway carriages, railroad carriages, lift cabins, cableway cabins and the like, and in particular to locking them in the closed position.

Doors of vehicles in which persons are transported must remain reliably in the closed position during travel. It is therefore not sufficient to close them by their drive, but it is rather necessary to provide locking devices for them. Such locking devices should of course automatically engage when the door closes and, in normal operation, be released by the drive at the beginning of the opening movement. It must also be possible for the locking devices to be unlocked by the users in emergency operation, for example in the event of the normal door drive failing, so that the doors can be opened manually as a result.

In the case of door drives in which the door leaf or door leaves is/are moved by a spindle mechanism, it has long been known not to arrange the spindle nut in a rotationally fixed manner at the works but to mount it to be rotatable at least within limits. It is also known to provide the spindle with a radially projecting finger which slides in a connecting link and thus provides the rotational locking, making it possible for the nut to act as a spindle nut. Such a drive is known, for example, from DE 28 19 424 A. In that position of the nut, which corresponds to the closed position of the door, the connecting link has a widened portion or a bend which allows the spindle nut to pivot by a predefined amount under the applied torque. Thus, even when the drive is deactivated, the spindle nut cannot move, as a result of banging on the door leaf, into that angular position in which it can be displaced along the predominant part of the connecting link. The door is locked in the closed position. For emergency actuation, elements are provided which act on the finger of the spindle nut and thus allow the nut to rotate into the position aligned with the deflecting connecting link. In the DE 2819424A document, further locking elements are provided which are activated by the nut moving into the end position formed.

Further locking arrangements of the above type are known in various embodiments from U.S. Pat. No. 5,341,598 A, from U.S. Pat. No. 6,446,389 B, from EP 903 275 A and from EP 452 201 A. In some of those documents, the spindle is designed such that the nut engages by a finger in a thread groove on the spindle, and such that the thread groove has a varying gradient. Others of those documents collectively disclose devices such as that mentioned above.

The above-mentioned locking devices have been substantially proven, but all have the disadvantage that problems can occur in unlocking the locking mechanism. Such problems can occur in the case of overcrowded vehicles, dirty guides, iced-up drives, or door guides and/or drives which have been adjusted to the edge of their tolerances or, as often occurs in rough operation, beyond their tolerances. As can be seen from at least one of the designs described above, the drive force or drive torque for displacing the door leaf is available for providing unlocking. That can, on various occasions, in conditions such as persons leaning against the door leaf as a result of overcrowding, etc., be insufficient to apply the torque required to rotate the finger.

The present disclosure, therefore, relates to a locking device which provides greater forces or torques for unlocking the locking mechanism than for a normal movement of the door leaf or door leaves.

According to the present disclosure, the door drive, which comprises the motor, a transmission and a drive spindle, is provided with a torque dividing arrangement which, when the spindle is fixed and the motor is activated, conducts a resulting reaction torque via a locking transmission to the locking device.

Since the door leaves cannot move further when they reach the closed end position of the doors, their connection to a spindle nut prevents any further rotation of the spindle. The result is that the reaction torque is transmitted to the locking mechanism by the torque dividing arrangement, according to the present disclosure. The locking transmission makes it possible to freely select the active torque, and therefore the active locking and unlocking force, within wide limits.

Torque dividing arrangements have long been known in transmission design, and reference is made here only to the planetary gear set. It is of course also possible to design the dividing arrangement differently. That is, it is possible, for example, to mount the motor itself so as to be rotatable or pivotable, so that the reaction torque causes the motor housing to pivot, and to derive the locking or unlocking action from the movement of the motor housing.

Other aspects of the present disclosure will become apparent from the following descriptions when considered in conjunction with the accompanying drawings.

DETAILED DESCRIPTION

Figure 1:
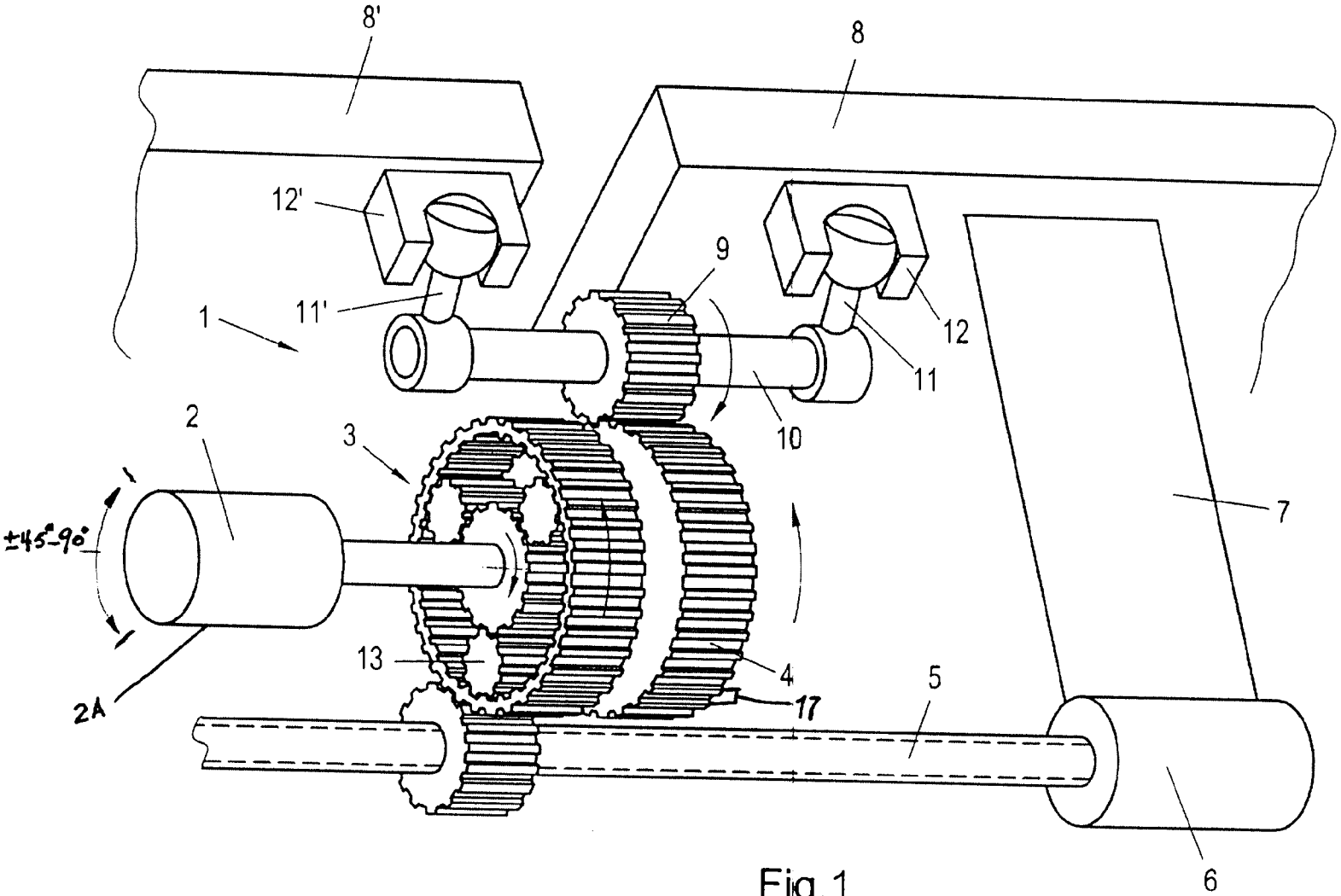
FIG. 1 shows a perspective view of an embodiment of a locking device having two planetary gear sets according to the present disclosure.

FIG. 1 schematically illustrates a drive and a locking device, according to the present disclosure, for a sliding door having two leaves 8, 8'. An electric motor 2 acts on a drive planetary gear set or drive transmission 3, which sets a spindle 5 in rotation. A spindle nut 6 is mounted on the spindle 5 so as to be longitudinally displaceable but rotationally fixed. Spindle nut 6 is connected to door leaf 8 by a fixed connection or connecting leaf 7. Symmetrically thereto, door leaf 8' is connected to a connecting leaf (not shown) and another spindle nut (not shown) is connected to the drive.

An end position of door leaves 8, 8' is illustrated in FIG. 1. A remaining door gap is closed off by rubber seals or the like (not shown). Locking elements 12, 12' are arranged on each respective door leaf 8, 8' and move into a region of pivotable locking fingers 11, 11' which are rotationally fixedly arranged on a locking shaft 10. The locking shaft 10 supports a gearwheel 9 which is operatively connected to a locking planetary gear set or locking transmission 4. Locking transmission 4 is connected to the drive transmission 3 by planet gears 13.

For example, if motor 2 is activated in an opening direction, it is not possible to move the door leaf 8 by engagement between the locking element 12 and the locking finger 11. The result is that any rotation of the spindle 5 is prevented by fixed connection or connecting leaf 7 and the spindle nut 6. As a result, it is also not possible for an outer wheel of the drive transmission 3 to be set in rotation. A motor torque sets the planet gears 13 in rotation, such rotation being transmitted to the locking transmission 4. With a fixed transmission ratio of the locking transmission 4, the gearwheel 9 is set in rotation, and with it the locking shaft 10 and the locking finger 11. An identical operation applies to door leaf 8'.

Again, for example, as a result of the locking finger 11 pivoting out of locking element 12, the door leaf 8 is released, resulting in the drive transmission 3 being set in motion and with it the spindle 5, and the opening movement of the door begins. In order to limit the rotation of the locking shaft 10 to a practicable amount, stops 15, are provided, and this may also ensure that full motor torque is available to provide drive after the unlocking process.

The present disclosure is not limited to twin-leaf doors. For single-leaf doors, the second locking element 12' can be provided on the vehicle body or on a wall of the vehicle body.

During a closing process, the operations take place in the reverse order. When the door leaves 8, 8' have reached the end position as shown, the spindle 5 can be rotated no further and the locking mechanism 1 is locked by a torque dividing arrangement in the drive transmission 3.

Figure 2B:
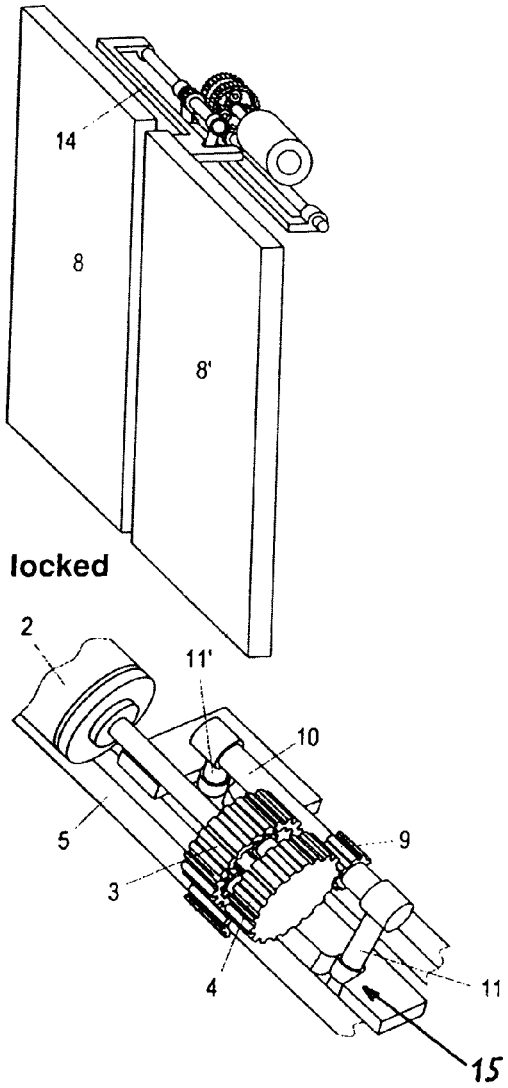
FIG. 2 shows door leaves of a door in an open and in a closed position, the door including a locking device according to FIG. 1, and having a connecting link which monitors the attainment of the closed position.
Figure 2A:
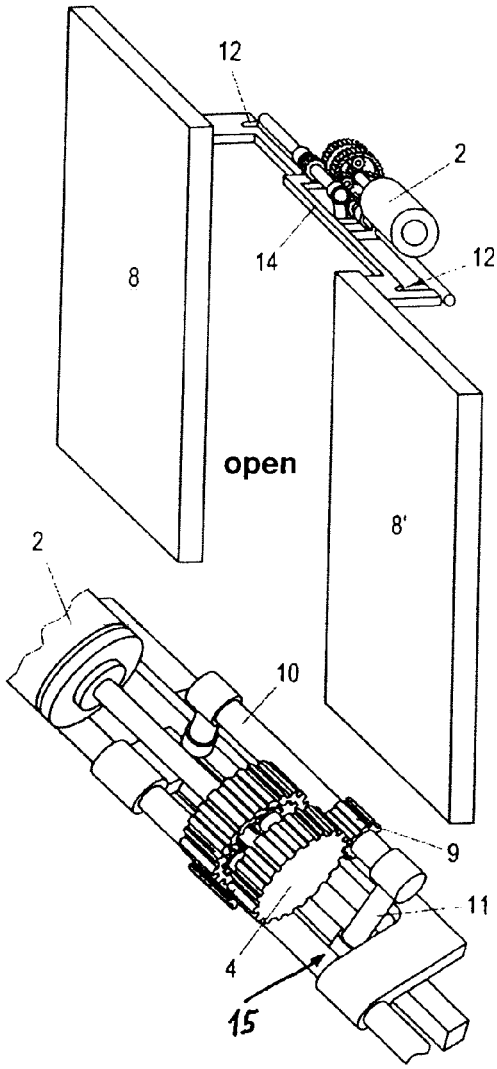
Figure 3:
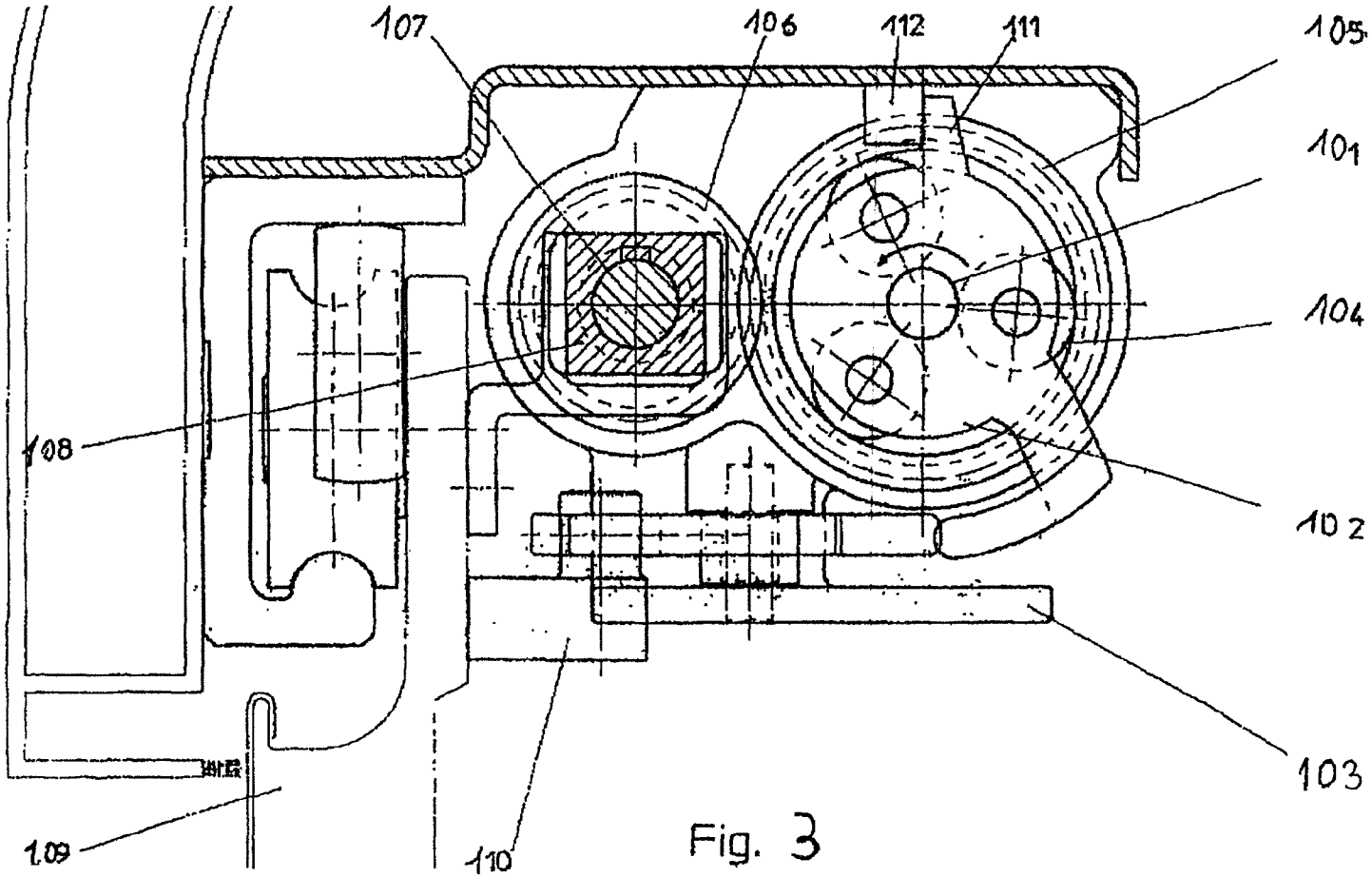
FIGS. 3 to 8 show various sections of another embodiment according to the present disclosure.
Figure 4:
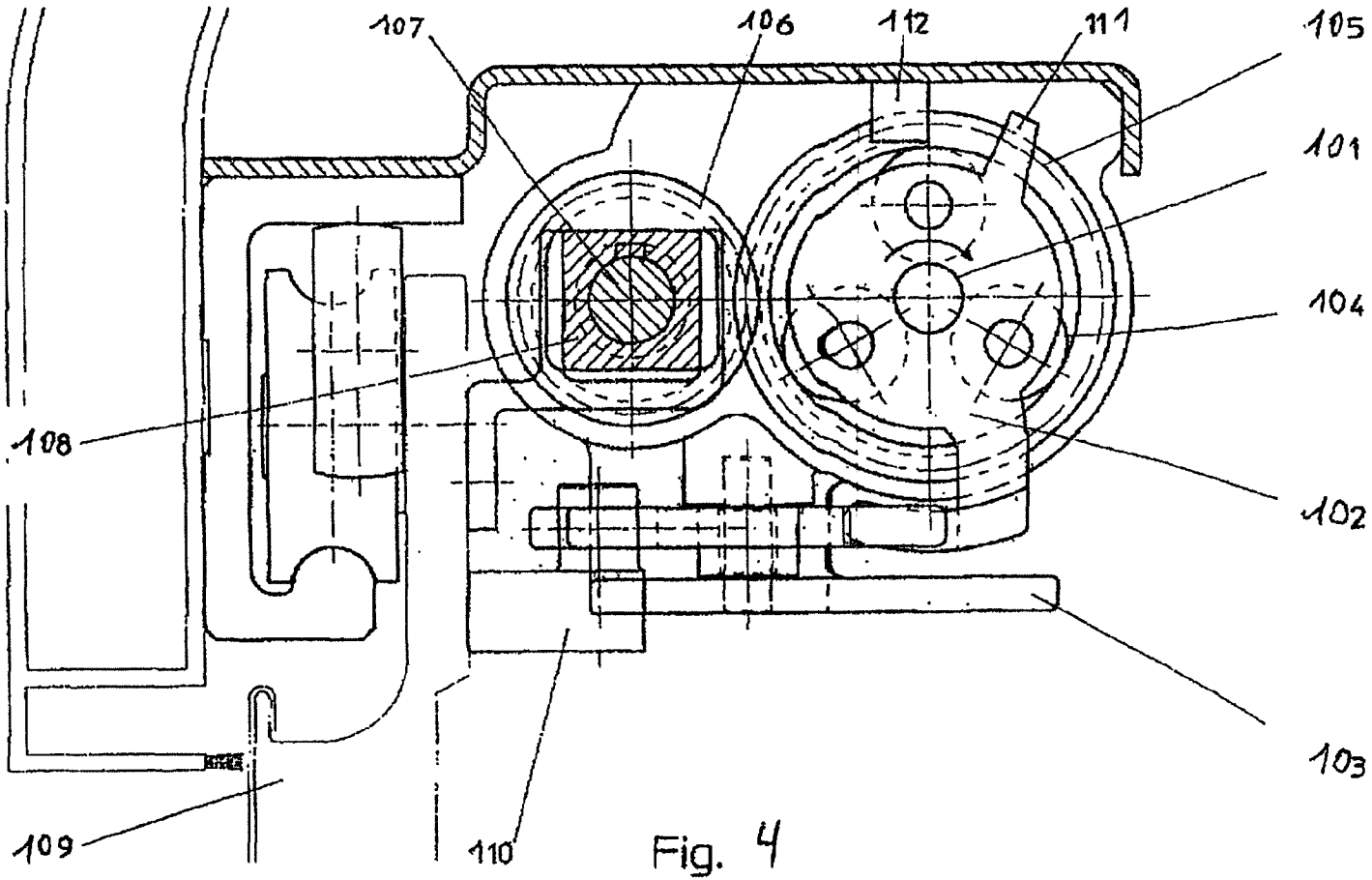

FIG. 2, further illustrating the embodiment of FIG. 1, shows a connecting link 14 in which the locking element 12 is integrally formed. A purpose of the connecting link 14 is to prevent locking in those cases in which the movement of a door leaf 8, 8' is prevented, for example as a result of trapped persons or objects, in a position which does not correspond to the closed position. The connecting link 14 also prevents the locking axle or shaft 10 from pivoting, and the resulting reaction torque, which corresponds to the motor torque, can, for example, be used to detect an incidence of persons or objects being trapped.

The locking device and the arrangement of the drive for twin-leaf doors in a region of a main closing edge has a functional advantage, and also an advantage that the important and relatively bulky components are provided at a point of the doorway or portal that is most accessible and where there is the greatest availability of space. This facilitates inspections, adjustments and repairs.

The embodiment of FIGS. 1 and 2 shows a sliding door. It is possible to use the locking device or arrangement, according to the present disclosure, with swing and sliding doors in which the drive serves both to guide the door leaves 8, 8' longitudinally and to impart a swinging-out movement out of the plane of the portal. A brake 17 or the like can be provided on the locking transmission 4. The brake may be engaged at a very beginning of the opening movement so that the swinging-out movement takes place as a result of the reaction torque on the motor housing 2A whereupon the brake is released, the locking action is released and, after unlocking is complete, the opening movement of the door leaves 8, 8' begins.

It is not necessary for an engagement of the locking fingers 11 to be restricted by connecting link 14 to the closed end position. It is possible to detect the position of the door leaves 8, 8' in another way and to prevent the engagement by the brake on the locking transmission 4 in all positions other than the closed end position. This is advantageous for swing and sliding doors in which a brake as noted above is already provided.

As briefly indicated above, it is not necessary for two planetary gear sets 3, 4 to be used in order to provide the torque dividing arrangements. However, transmissions 3, 4 are components that have robustness, compactness and large step-up or step-down transmission ratios which can be easily obtained within wide limits.

FIGS. 3 to 8 show another embodiment of the present disclosure in which the very action of the door leaves entering the closed end position provides the locking action. In this embodiment, a simple sliding door is shown, although this embodiment can also include swing and sliding doors. Thus, it is only necessary to match or refer to those elements of the locking device which interact with actuating elements on the door leaves to an oblique movement direction of the door leaves upon reaching the closed end position. In order to be distinguished from the first embodiment of FIGS. 1 and 2, the reference symbols in FIGS. 3-8 have three digits, beginning at 101.

The locking device comprises a motor 113 which drives a sun gear 101 of a planetary gear set. The planetary gear set has an internal gear 104 which is rotationally fixedly connected to a gearwheel 105 having an outer toothing which itself meshes with a gearwheel 106 which in turn sets a spindle 107 in rotation. One nut 108 for each door leaf 109 is seated on the spindle 107 so as to be rotationally fixed. The nut 108 is displaced along the spindle or axle 107 as a result of the rotation of the spindle 107, and in this way driving its respective door leaf 109 and displacing the latter between an open position and a closed position. Door drives of this type are widely known and require no further explanation here.

Figure 5:
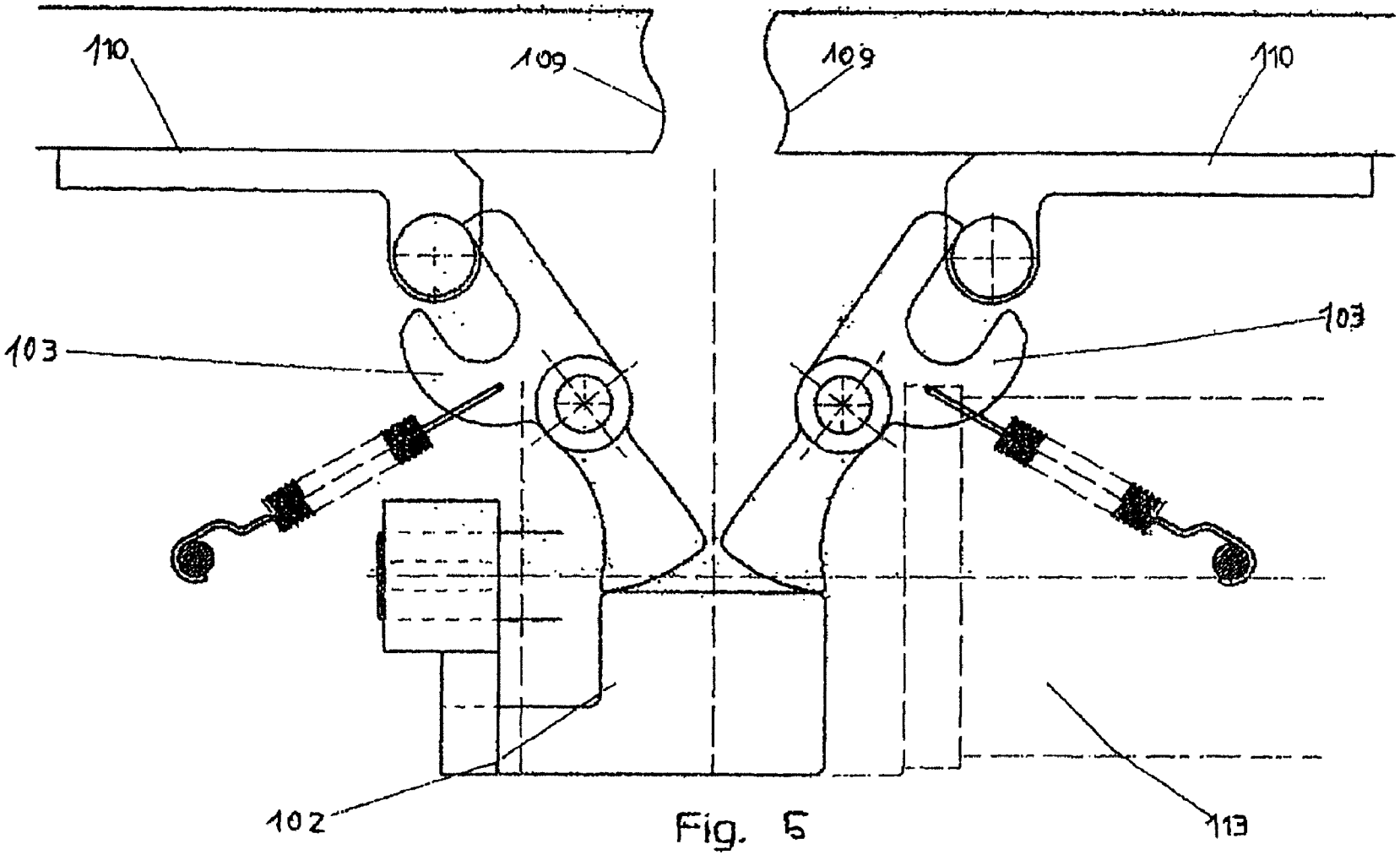

Fixedly connected to the door leaves 109 are locking bolts 110 which, during the closing end movement of the door leaves 109, pass by relatively short prongs and come into contact with relatively long prongs of latches 103, and pivot the latches 103 into the closed position (see FIG. 6) counter to a force of springs 119 (see FIG. 6) which push the latches 103 into the open position (FIG. 5). In this embodiment, the springs 119 are coil springs which are loaded under tension. It is possible to provide rotary springs about pivot axes of the latches 103, or one tension spring which can engage at corresponding points of those ends which are remote from prongs of the latches 103.

Figure 6:
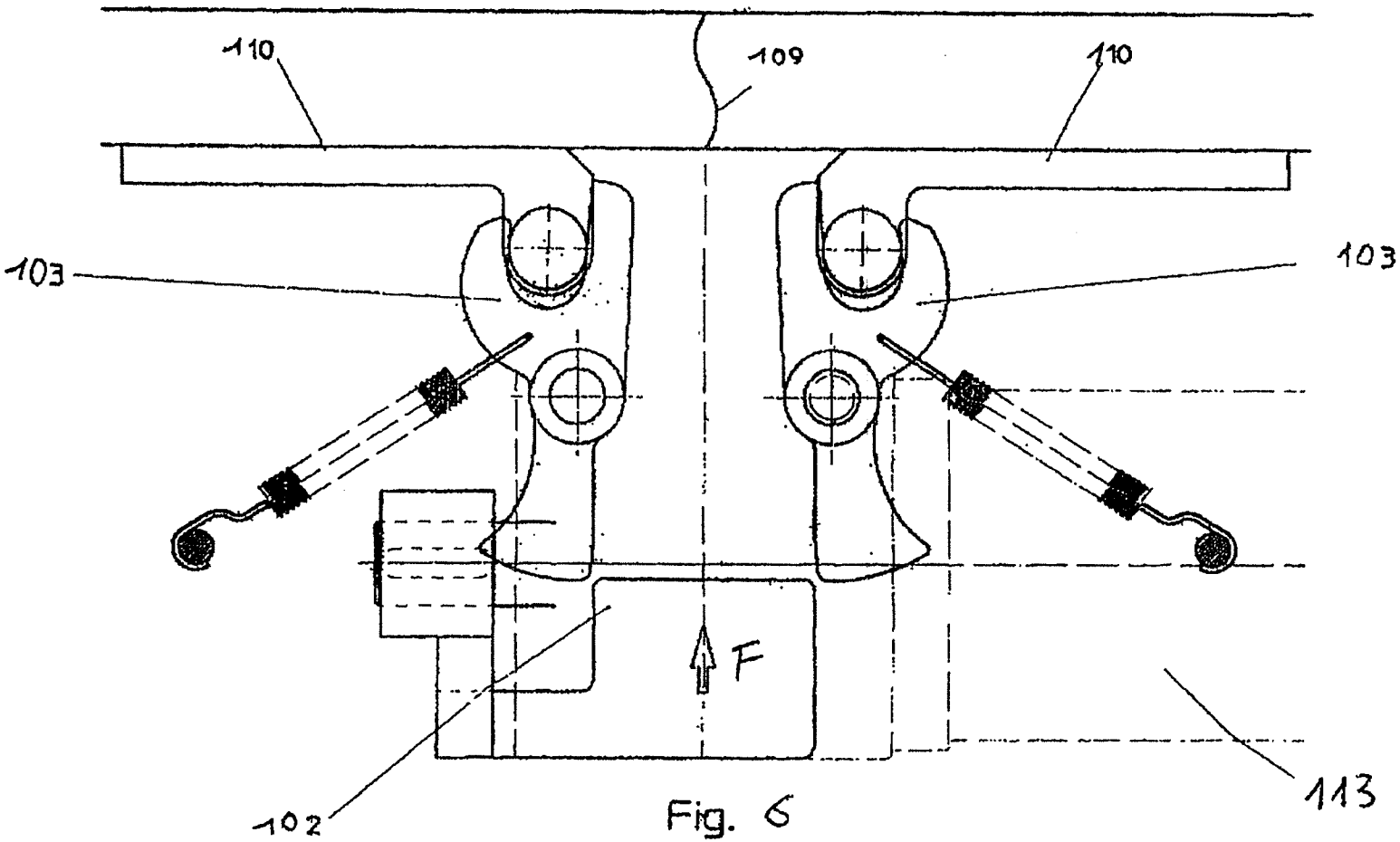
Figure 7:
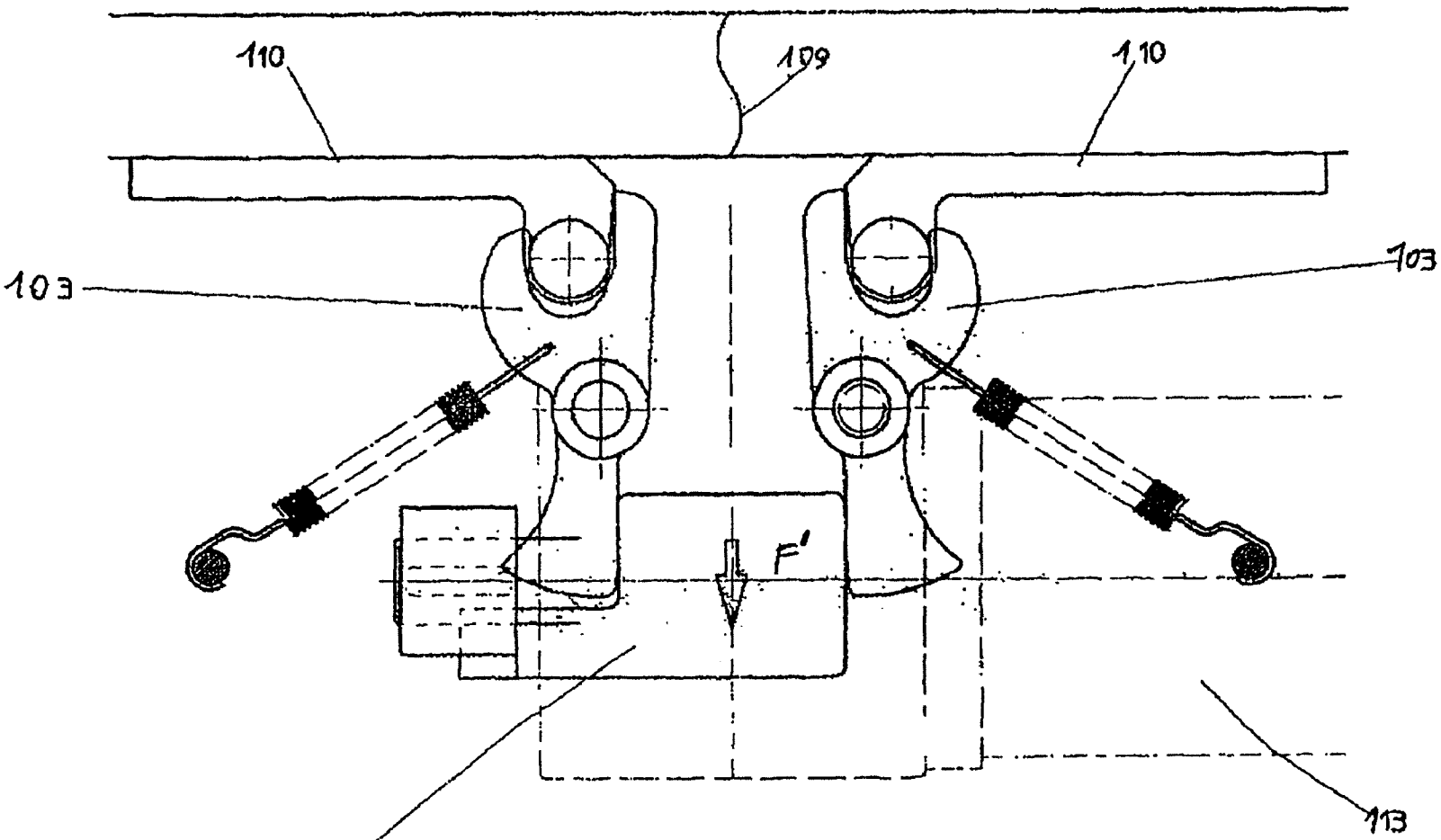
Figure 8:
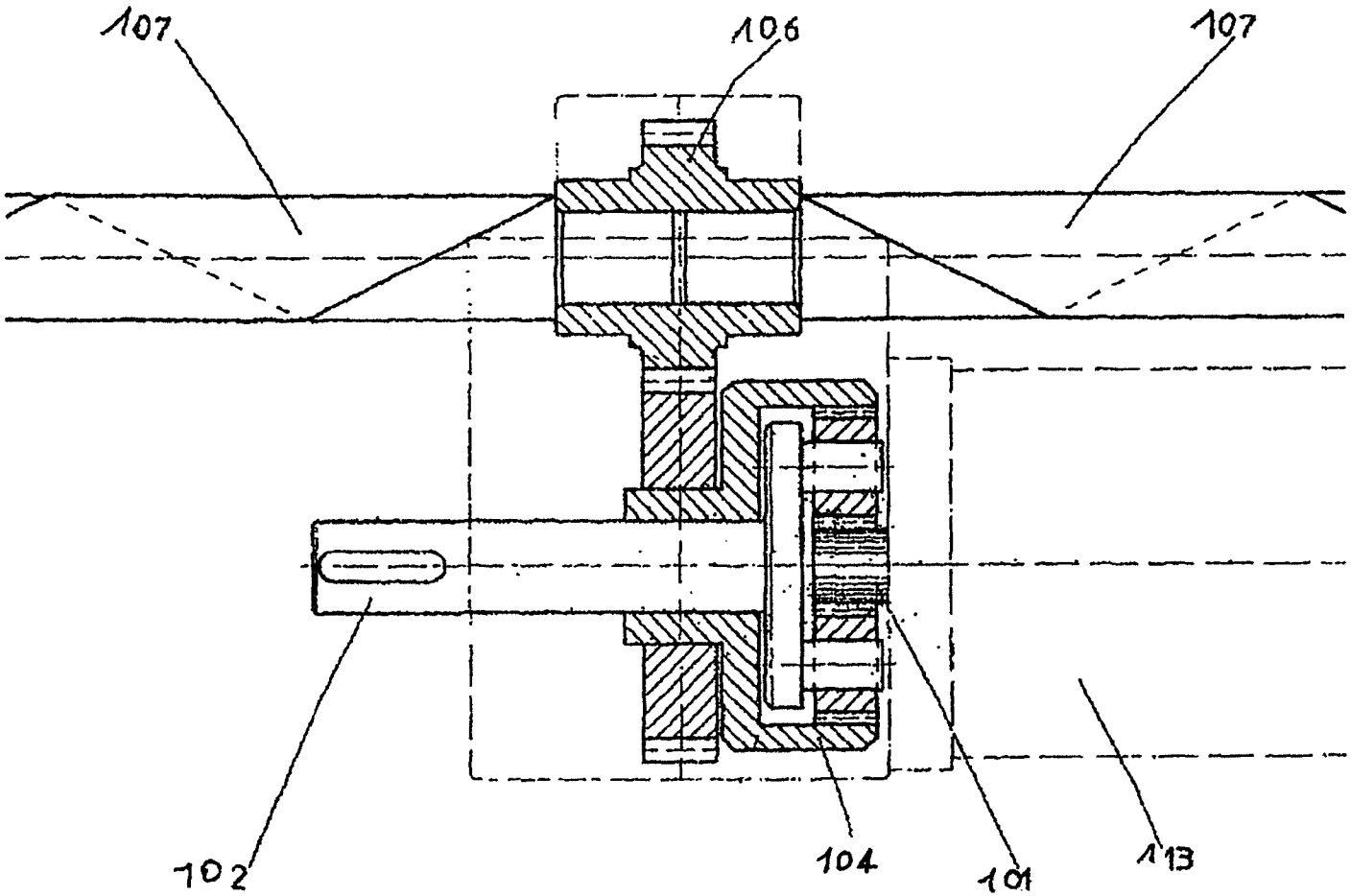

As a result of the pivoting movement of the latches 103, as shown in FIGS. 5 and 6, the movement of a locking element or lever 102 is permitted in a direction of the arrow F (see FIG. 6). The locking lever 102 is connected to a planet annulus of the planetary gear set (see FIG. 3). During a closing of the doors, after the latches 103 have pivoted, the locking lever 102 is pivoted into the position illustrated in FIG. 7 in which it bears either against a housing of the planetary gear set or, by a shoulder, against a rear side of one of the latches 103.

When the locking lever 102 reaches its end position, the door drive is thus blocked and cannot be opened by any opening force, no matter how large, acting on the door leaves 109. This is only possible by activating the motor 113 in the opening direction. Since the motor torque is not capable of moving the door leaves 109 or their locking bolts 110 out of the prongs of the latches 103, the planet gear, and therefore its part embodied as a locking lever 102, rotates in the direction of the arrow F' in FIG. 7 until the position illustrated in FIG. 6 is reached. A stop of the planetary gear set 111 (see FIG. 3) then comes into contact with a catch 112 of the housing or vehicle body, and the full motor torque is then transmitted to the internal gear 105 and therefore via the gearwheel 106 to the spindle 107. That initiates the opening of the doors with assistance from the spring 119, which acts in the opening direction, of the latches 103.

The embodiment of FIGS. 3-8 can be modified in various ways. The prongs can be mounted differently or else can have a common pivoting point and can vacate the space for the locking lever 102 by a correspondingly angled design. The fact that other spring arrangements can be selected has already been explained further above. The design of the locking bolts 110 can be altered in various ways. For example, where the closing end movement of the door leaves 109 runs obliquely for the swing and sliding doors. It is possible to provide a design in the form of rollers to reduce friction, or to provide a resilient design etc. The force division or torque division of the motor 113 in the form of a planetary gear set, and the simple and robust design of the planet annulus, provide a compact and durable construction which also allows an emergency opening device. That is an essential prerequisite in many applications, to be easily attached by direct action on that part of the planet annulus which is designed as a locking lever 102. The planet annulus need not directly support the locking lever or even be integrally formed with the latter even though this constitutes a simple and robust construction.

It is also possible to provide, instead of the locking bolts 110 on each door leaf 109, a contact track having a recess, on which contact track a roller, which is arranged on the end of the locking lever 102, runs until it passes into the recess and thus allows the locking lever and therefore the planet annulus to pivot.

In the last two possible embodiments, it is mechanically favorable and often requested by clients that the respective open/closed state is also maintained in the event of drive power being lost. This can be provided by a compression spring acting "from the outside" on the projecting part of the planet annulus. The compression spring comes to rest, in one of the two end positions, at the right, and in the other end position, at the left of the straight connecting line between its mounting point, which is fixed to the vehicle body, and the rotational axis of the planet annulus.

There are of course other possibilities; for example, a tension spring can engage on an end face of the planet annulus and run "inward", or a spring can engage on another component of the drive.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A locking device for sliding doors or swinging and sliding doors, the doors having two door leaves, the locking device comprising:

a drive train including one motor having a first axis of rotation, a drive transmission, and a drive spindle having a second axis of rotation, the first and second axes of rotation being parallel to each other;

a locking transmission;

a torque dividing arrangement connecting the drive transmission to the locking transmission, and wherein when the drive spindle is longitudinally fixed and the motor is activated, the torque dividing arrangement conducts a resulting torque via the locking transmission to a locking mechanism to move the locking mechanism to lock the two door leaves, and a spindle nut is connected to the drive spindle, the spindle nut being rotationally fixed but longitudinally displaceable and configured to move the two door leaves.

2. The locking device as claimed in claim 1, wherein the drive transmission and the locking transmission are planetary gear sets which are connected to one another by planet gears of the torque dividing arrangement.

3. The locking device as claimed in claim 1, wherein for purposes of torque division, the motor is mounted so as to be rotatable, and a reaction torque causes a motor housing to rotate such that the motor acts on the locking mechanism.

4. The locking device as claimed in claim 1, wherein the locking mechanism includes a gearwheel which is operatively connected to the locking transmission and to a locking shaft which supports the gearwheel, and locking fingers are arranged in a rotationally fixed manner on the locking shaft, the locking fingers engaging, in a locked state, in at least one locking element of the at least one door leaf.

5. The locking device as claimed in claim 4, wherein the at least one locking element is integrally formed in a connecting link.

6. The locking device as claimed in claim 4, wherein stops are provided which delimit a rotation of the locking shaft.

7. The locking device as claimed in claim 1, wherein a brake is provided on the locking transmission, the brake being engaged at a beginning of an opening movement.

8. The locking device as claimed in claim 1, wherein the drive transmission is a planetary gear set whose planet annulus is rotatable between two angular positions and one of supports and actuates a locking element, and locking bolts, which interact with the locking element, the locking element being connected to the at least one door leaf.

9. The locking device as claimed in claim 8, wherein one end of a spring engages on one of the planet annulus and locking element, and another end of the spring engages on a point which is fixed relative to the door, and the spring passes through a dead point between two end positions of the door.

* * * * *